US007612731B2

(12) United States Patent
Peterson

(10) Patent No.: US 7,612,731 B2
(45) Date of Patent: Nov. 3, 2009

(54) METHODS AND APPARATUS FOR REDUCING RADIO FREQUENCY INTERFERENCE FOR COLLOCATED ANTENNAS

(75) Inventor: Lewis Peterson, La Habra, CA (US)

(73) Assignee: Raytheon Company, Waltham, MA (US)

( * ) Notice: Subject to any disclaimer, the term of this patent is extended or adjusted under 35 U.S.C. 154(b) by 217 days.

(21) Appl. No.: 11/693,971

(22) Filed: Mar. 30, 2007

(65) Prior Publication Data

US 2007/0257856 A1 Nov. 8, 2007

Related U.S. Application Data

(60) Provisional application No. 60/787,984, filed on Mar. 31, 2006.

(51) Int. Cl.
*H01Q 1/52* (2006.01)
*H01Q 19/12* (2006.01)

(52) U.S. Cl. ..... 343/841; 343/840; 343/851

(58) Field of Classification Search ..... None
See application file for complete search history.

(56) References Cited

U.S. PATENT DOCUMENTS 3,075,977 A * 1/1963 Zirkle ..... 544/47
5,335,366 A * 8/1994 Daniels ..... 455/575.5
5,864,323 A * 1/1999 Berthon ..... 343/788
6,677,915 B1 * 1/2004 Yablonovitch et al. ..... 343/841
6,914,577 B2 * 7/2005 McCandless ..... 343/841
7,348,930 B2 * 3/2008 Lastinger et al. ..... 343/844
7,394,429 B2 * 7/2008 Fang et al. ..... 343/702
2005/0104782 A1 5/2005 Peled et al.

FOREIGN PATENT DOCUMENTS

WO WO 01/50545 A1 7/2001
WO WO 02/101410 A2 12/2002
WO WO 02/101410 A3 12/2002

OTHER PUBLICATIONS

PCT/US2007/008023 International Search Report dated Sep. 3, 2007.
RF Device and Antennas Branch, Link-16 Antenna, AS-4127A/URC-107(V), Feb. 2003, San Diego, California.

* cited by examiner

*Primary Examiner*—Trinh V Dinh
(74) *Attorney, Agent, or Firm*—Daly, Crowley, Mofford & Durkee, LLP

(57) ABSTRACT

Methods and apparatus for a plate to prevent energy from a first antenna from interfering with a collocated second antenna. In one embodiment, the plate includes first and second conductive layers to shadow the second antenna and thereby block energy from reaching the second antenna. A resonant quarter wavelength spacing of the plates forces energy broadside minimizing the spillover the edge caused by diffraction. Multiple conductive layers having increasing radii can block diffracted energy from spilling over and around the plate. The multiple plates of increasing radii affect a waterfall-like spill wherein energy is lost in each level.

13 Claims, 5 Drawing Sheets

| Layer i | Thickness, inches $d_i$ | Radius, inches $R_i$ |
|---|---|---|
| 1 | 2.5 | 39.2 |
| 2 | 2.6 | 40.8 |
| 3 | 2.8 | 44.3 |
| 4 | 3.0 | 46.8 |
| 5 | 1.5 | 49 |

METHODS AND APPARATUS FOR REDUCING RADIO FREQUENCY INTERFERENCE FOR COLLOCATED ANTENNAS

CROSS-REFERENCE TO RELATED APPLICATIONS

The present application claims the benefit of U.S. Provisional Patent Application No. 60/787,984, filed on Mar. 31, 2006, which is incorporated herein by reference.

STATEMENT REGARDING FEDERALLY SPONSORED RESEARCH

The Government may have certain rights in the invention pursuant to Contract No. F19628-03-C-0027.

BACKGROUND OF THE INVENTION

As is known in the art, frequency bands within the radio frequency spectrum can be used for multiple purposes, such as radio communications and radar. In some cases, it may be desirable to collocate the antennas of multiple systems that are operating within the same frequency band. Typically, each of these antennas will be designed to transmit and/or receive radio frequency electromagnetic energy with high gain over a limited angular range, or main lobe. However, such antennas also transmit and receive electromagnetic energy, at lower gain, at other angles outside of the main lobe. Thus, radio frequency interference can occur between multiple systems even if each antenna is positioned outside of the main lobes of the other collocated antenna.

FIG. 1 shows a prior art antenna installation 100 having a first antenna 110 and a second antenna 120 collocated within radome 140. In the illustrated installation, the first antenna 110 is a so-called LINK-16 communications antenna operating in the L-band at frequencies from 960 MHz to 1215 MHz. As is well known in the art, Link-16 provides a U.S. government-backed system for transmitting broadband data across a variety of air, sea and ground-based platforms. The second antenna 120 is a combination of an L-band radar and an IFF (Identification Friend or Foe) antenna operating at frequencies of 1030 MHz and 1090 MHz. The IFF antenna is located at the upper portion of the antenna combination 120.

In the illustrative installation, the first antenna 110 has a torroidal main lobe that covers 360 degrees in azimuth and roughly 20 degrees in elevation centered on horizontal. The second antenna 120 has a narrow fan beam that is scanned by means of a mount 130 that rotates antenna 120 about the vertical axis.

While each of the first and second antennas 110, 120 are positioned outside of the main lobe of the other antenna, radio frequency interference can still occur due to stray or side lobe radiation between the antennas, as shown schematically by dashed lines 150. Of particular concern in this example is radiation from the communications antenna 110 degrading the performance of the radar/IFF system, which has high sensitivity in order to receive radar returns from distant objects.

SUMMARY

The present invention provides methods and apparatus for a plate to reduce interference by a first antenna with a collocated second antenna operating in the same frequency band. The plate includes first and second conductive layers to shadow the second antenna and thereby block energy from reaching the second antenna. A resonant quarter wavelength spacing of the plate layers forces energy broadside to minimize layer spillover caused by diffraction. Multiple conductive layers having increasing radii can block diffracted energy from spilling over and around the plate.

In one aspect of the invention, an apparatus comprises an apparatus including a first conductive layer, a dielectric layer proximate the first conductive layer, and a second conductive layer substantially parallel to the first conductive layer and proximate the dielectric layer so that the first and second conductive layers sandwich the dielectric layer to create a resonant cavity for reducing radio frequency interference between a collocated first antenna and a second antenna operating in a first frequency band.

The apparatus can further include one or more of the following features: the first and second layers are parallel to within a tenth of a wavelength within the frequency band, the first conductive layer has a surface area that is sufficient to shadow the first antenna from the second antenna, the first and second conductive layers are disposed in parallel with a distance between the first and second conductive layers being one-quarter of a wavelength of an operating frequency of the first antenna within the first frequency band, a thickness of the dielectric layer is selected to take into account attenuation of velocity of wave propagation to achieve the one-quarter wavelength, the dielectric layer includes a foam material, air, or any suitable material for mechanical rigidity, a third conductive layer generally parallel to the second conductive layer, a distance between adjacent ones of the first, second, and third conductive layers is one-quarter wavelength of the operating frequency within the first frequency band, the first and second conductive layers are concentric circular disks, and the first plate optically shadows the second antenna.

In another aspect of the invention, an antenna installation system includes a first antenna, a second antenna collocated with the first antenna, and a plate optically shadowing the second antenna from the first antenna, wherein the plate comprises a first conductive layer, a dielectric layer proximate the first conductive layer, and a second conductive layer substantially parallel to the first conductive layer and proximate the dielectric layer so that the first and second conductive layers sandwich the dielectric layer to create a resonant cavity for reducing radio frequency interference between a collocated first antenna and a second antenna operating in a first frequency band.

The antenna installation system can further include one or more of: the first and second conductive layers are disposed in parallel with a distance between the first and second conductive layers being one-quarter of a wavelength of an operating frequency of the first antenna within the first frequency band, a third conductive layer generally parallel to the second conductive layer, the first and second conductive layers are concentric circular disks.

In a further aspect of the invention, a method comprises providing a first conductive layer, providing a dielectric layer proximate the first conductive layer, providing a second conductive layer substantially parallel to the first conductive layer and proximate the dielectric layer so that the first and second conductive layers sandwich the dielectric layer to create a resonant cavity for reducing radio frequency interference between a collocated first antenna and a second antenna operating in a first frequency band.

The method can further include one or more of the first and second conductive layers are disposed in parallel with a distance between the first and second conductive layers being one-quarter of a wavelength of an operating frequency of the first antenna within the first frequency band, the dielectric layer includes a foam material, the first and second conductive layers are concentric circular disks, the plate optically shadows the second antenna.

BRIEF DESCRIPTION OF THE DRAWINGS

The foregoing features of this invention, as well as the invention itself, may be more fully understood from the following description of the drawings in which.

DETAILED DESCRIPTION OF THE INVENTION

In general, the present invention provides method and apparatus to reduce/prevent energy from a first antenna from interfering with a second collocated antenna. Creating resonant chambers forces radiation perpendicular to an axis of driven elements while minimizing subtraction from the main beam. In one embodiment, concentric disks are sized to an even number of wavelengths in radius for frequencies of interest. The stacked disks diminish diffraction components from disk edges. This arrangement maintains broadside radiation while reducing diffraction components and eliminating direct illumination of the collocated antenna.

Figure 1:
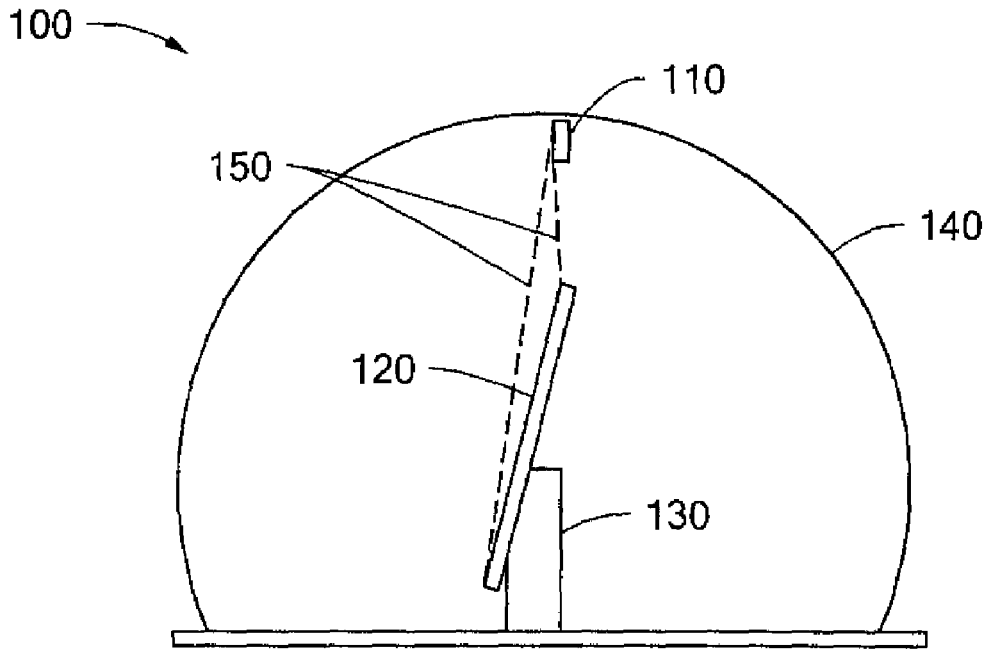
FIG. 1 PRIOR ART
FIG. 1 is a schematic cross-sectional view of a prior art antenna installation with multiple radio frequency antennas.
Figure 2:
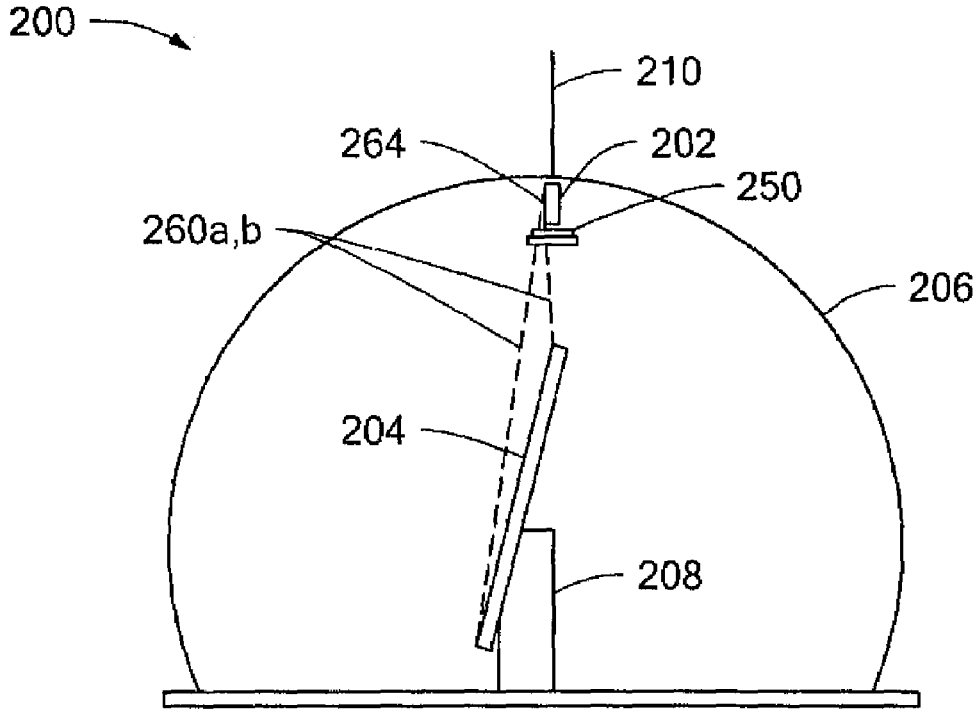
FIG. 2 is a schematic depiction of an antenna installation having a first antenna with an apparatus to prevent interference with a second antenna in accordance with exemplary embodiments of the invention.

FIG. 2 shows an exemplary antenna installation 200 having a first antenna 202 and a second antenna combination 204 collocated within a radome 206. The first antenna 202 is a so-called LINK-16 communications antenna operating in the L-band at frequencies from 960 MHz to 1215 MHz. The second antenna 204 is an L-band radar and IFF (Identification Friend or Foe) antenna operating at frequencies of 1030 MHz and 1090 MHz.

Figure 2A:
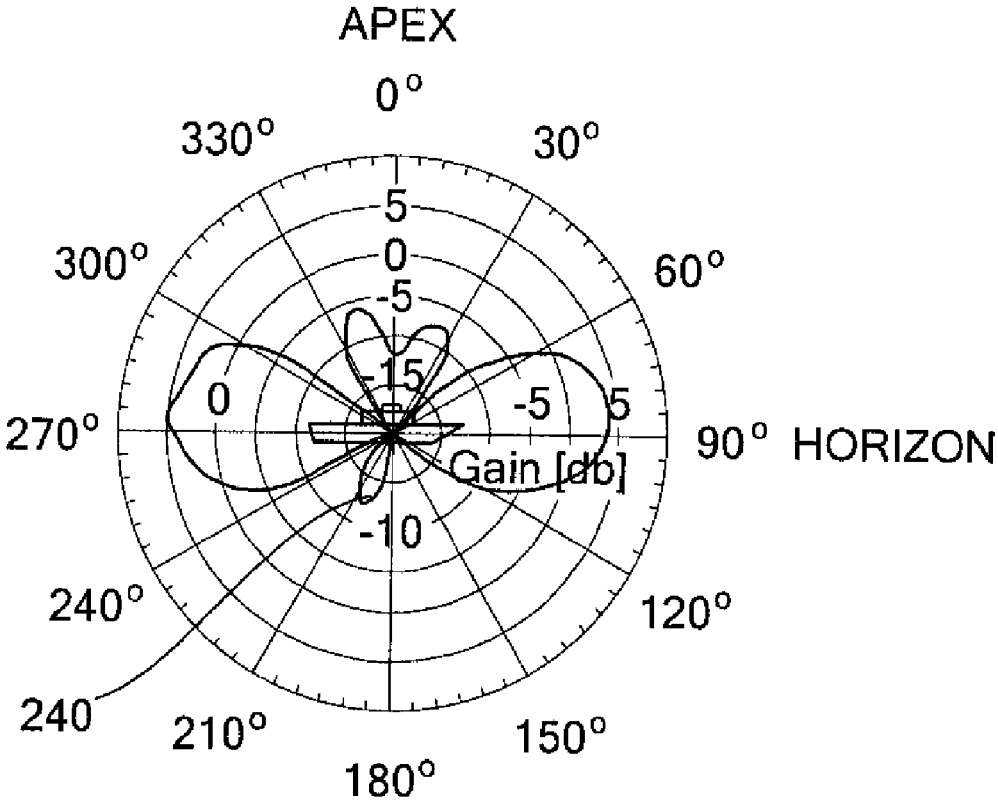
FIG. 2A shows a first antenna radiating energy that can be blocked by a plate in accordance with exemplary embodiments of the invention to prevent or reduce interference with a second antenna.

The first antenna 202 has a torroidal main lobe that covers 360 degrees in azimuth and roughly 20 degrees in elevation centered on horizontal. The second antenna 204 has a narrow fan beam that is scanned by means of a mount 208 that rotates second antenna 204 about the vertical axis 210. As shown in FIG. 2A for example, the Link-16 antenna 202 may radiate energy 240 at an angle approaching 90 degrees from the horizon, i.e., 180 degrees from the apex, that can interfere with the second antenna 204 and associated IFF system operation.

The installation 200 includes a plate 250 located between the first and second antennas 202, 204 so as to prevent energy from the first antenna 202 from interfering with signals received by the second antenna 204. In general, the plate 250 blocks signal energy from the first antenna 202 that would fall on the second antenna 204. In the illustrative embodiment, first and second lines 260*a,b* define a space over which energy from the first antenna 202 is blocked. Where the first and second antennas rotate and for a round second antenna 202, the space would correspond to a truncated or sliced cone defined by a perimeter of the second antenna 204 extending to a point or small area 264 associated with the first antenna 202. In the illustrative embodiment, the upper rotating IFF antenna is the most sensitive to the radiation of antenna 202 and thereby the region receiving the most protection.

In an exemplary embodiment, the size and position of the plate 250 is selected such that the plate shadows the second antenna 204 (victim) from the first antenna 202 (interferer). That is, the plate 250 obstructs the line of sight from any portion of the first antenna 202 to any portion of antenna 204.

While exemplary embodiments of the present invention are primarily shown and described in conjunction with particular antennas for particular radars having certain characteristics, frequencies, and operating parameters, it is understood that the invention is applicable to systems in general in which energy from one system may interfere with a second system. In addition, it is understood that the term "plate" should be construed broadly to cover any series of adjacent shapes, where shape should also be construed broadly. Other embodiments having different shapes for the plate are contemplated to meet the needs of a particular application. For example, where one or more antennas do not rotate, non-round, non-ovular etc., shapes may be used. For multiple interfering antennas in echelon the plate would be oval, for example. Should the interfering antenna be a horizontal array of vertical radiators, then an oval isolating disk(s) would be used instead of a circular one. In the illustrated embodiment, disks are used because of the rotation of the second antenna while the first antenna is fixed. The line-of-sight shadow determines the shape of the plates where no part of the victim antenna is in a direct (optical) line of sight to any currents on the interfering antenna.

Figure 3:
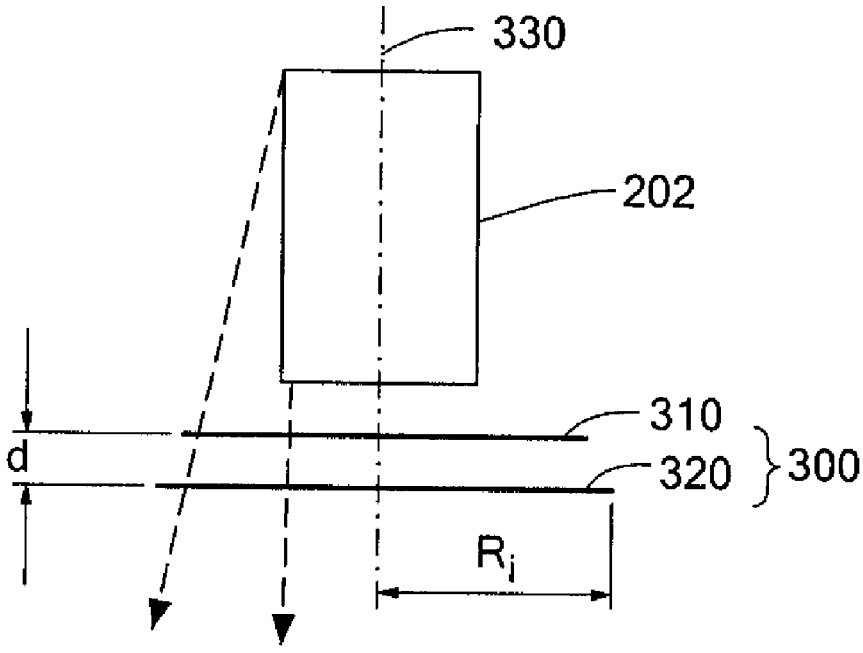
FIG. 3 is a schematic cross-sectional view of an apparatus in accordance with exemplary embodiments of the invention.

FIG. 3 shows a cross-sectional view of exemplary plate 300 comprising at least a first conductive layer 310 and a second conductive layer 320. The first and second conductive layers 310, 320 are disposed in parallel and are separated by a distance d. The conductive layers should be essentially orthogonal to the axis 330 of the first antenna. In one embodiment, distance d is equal to one-quarter of the wavelength of a frequency within the operating frequency band of first antenna 202. Thus, the space between the first and second conductive layers 310, 320 is a resonant cavity that radiates energy radially (in directions close to a plane normal to axis 330). This configuration minimizes the amount of energy that can reach the second antenna (204 in FIG. 2) and to minimize the effect that the conductive layers 310, 320 have on the main lobe radiation pattern from the first antenna 202.

In the exemplary installation, which is approximately symmetric about the vertical axis 330, the conductive layers 310, 320 will be circular discs. Each of these discs has a respective radius $R_i$, where $R_i$ is the radius of the i'th conductive layer (numbering starting from the conductor closest to the first antenna 202). In an exemplary embodiment, the radii $R_i$ of the first and second conductive layers 310, 320 is not equal. The radius of the first conductive layer 310 should be sufficient such that this conductor fully shadows the second antenna 204 from the first antenna 202.

A single conductive layer of this size will shield the second antenna 204 from direct radiation from the first antenna, but some energy from the first antenna 202, without the second layer, may still reach the second antenna 204 due to diffraction at the edge of the first conductive layer 310. In an exemplary embodiment, the second conductive layer 320 is larger than the first conductive layer 310 to obstruct energy diffracted at the edge of the first conductive layer 310.

In one embodiment, the radii $R_i$ of the conductive layers 310, 320 are selected to be even multiples of the wavelength of a frequency in the operating frequency band. For a given sub portion of the operating band of antenna 202, the radius of the top plate 310 is an even multiple of the upper bound frequency of the sub portion and the radius of the bottom plate 320 is an even multiple of the lower bound frequency of the sub portion. The number of sub portions chosen is to be organized according to the overall band of operation of antenna 202. For the Link 16 case, four sub portions were used.

As will be apparent to one of ordinary skill in the art, the term "conductor" for the conductive layers 310, 320 should be construed broadly to cover any material, or combination of materials, that provide adequate conductive properties to achieve the desired effect. In an exemplary embodiment, the thickness of the conducting plate need only be four skin depths or greater where the skin depth corresponds to the conductivity of the material used for the plate. For example, aluminum will be thicker than silver.

The material between the conductors is of any suitable dielectric with the requirement that the spacing between the plates be one quarter of a wavelength within the dielectric material. In general, a lightweight material is desirable (e.g., closed cell foam) for the dielectric subject to the mechanical need to fasten/contain the overall structure. It is understood that the dielectric material can be provided as air.

It is understood that the layers are nominally parallel; however, a random deviation of one tenth of a wavelength, for example, will have negligible impact the effectiveness of the plate. As used herein, parallel layers refer to layers that are sufficiently parallel to achieve the desired effect.

Figure 4:
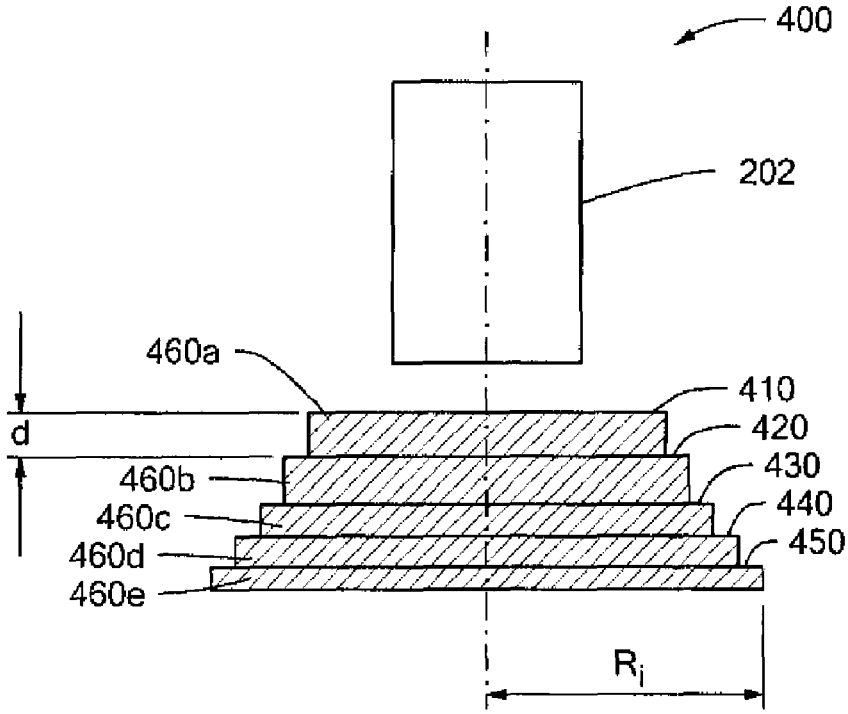
FIG. 4 is a schematic cross-sectional view of another embodiment of an apparatus in accordance with exemplary embodiments of the invention.
Figure 4A:
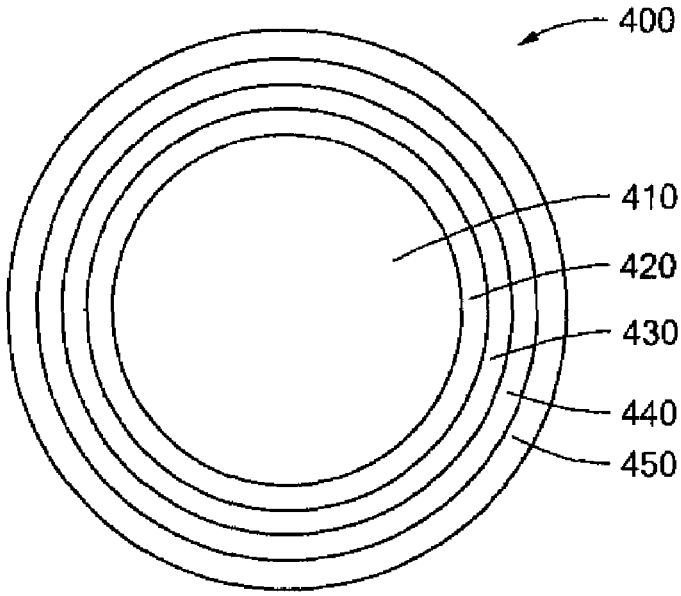
FIG. 4A is a top view of the apparatus of FIG. 4.

FIG. 4 is a cross sectional schematic view of another embodiment of a plate 400 having first, second, third, fourth, and fifth circular conductive layers 410, 420, 430, 440, 450. In an exemplary embodiment, the conductive layers are supported and separated by layers of dielectric material 460*a-e*. FIG. 4A is a top view of the plate 400 of FIG. 4.

It is understood that the dielectric material 460 can be provided from a variety of suitable materials selected based upon weight, cost, dielectric properties, and/or other factors. In one embodiment, the dielectric material 460 is provided as a foam material to minimize the weight and stabilize the shape of the absorbing/diffracting structure.

In one particular embodiment, each of the five conductive layers has a radius $R_i$ and each of the adjacent conductors are separated by a distance $d_i$, where $d_i$ is the distance between conductor i and conductor i+1. For example, $d_5$ is the thickness of the dielectric slab supporting the fifth conductor. The distances $d_1$, $d_2$, $d_3$, and $d_4$ are selected to be one-quarter wave of a frequency in the operating frequency band of the first antenna 110. In an exemplary embodiment, the distances $d_1$ to $d_4$ will be one-quarter wave for four different frequencies distributed across the operating frequency band of first antenna 110.

It is understood that at least two conductive layers are necessary to achieve the side 'squirting' resonance. While attempting to isolate an interferer having a narrow bandwidth compared to the center frequency with a single resonant chamber of two conductive layers may achieve adequate blocking, it is understood that additional layers to provide further resonant cavities can be added to cover a frequency range. For example, to cover the entire frequency region of a Link 16 antenna with one chamber would result in a relatively low quality factor, e.g., around four, and provide negligible isolation. However, waterfall spillover of successive diffraction is obtained by increasingly larger plates for enhanced isolation.

EXAMPLE

The distance between the top of the Link 16 radiating element to the top of the victim antenna complex is 99.5 inches. The radius from the symmetry axis of the Link 16 antenna to the top edge of the victim antenna is 157.5 inches. A plate having a radius of 32.8 inches placed at the bottom of the Link 16 antenna just intersects the maximum line of sight angle to the victim antenna. The high end of the Link 16 band is 1209 MHz so an even number of wavelengths of 1209 MHz greater than the line of sight would be an integer four. Thus, four wavelengths give a radius of the top conductive layer or disk 410 of 39.2 inches.

The Link 16 spectrum is composed of three sub portions: 966-1011 MHz, 1050-1068 MHz, and 1110-1209 MHz. The top portion is substantially wider in frequency than the lower two portions so it, in turn, is further divided into two portions. The top two disks 410, 420 create a resonant cavity at 1184 MHz as that is the geometric mean of the edges of the upper sub portion of the Link 16 frequency spectrum. Disk 420 is set to be four wavelengths at a middle region of the upper sub portion of the Link 16 band at 1161 MHz at 40.8 inches. The next gap or resonant cavity works at 1139 MHz corresponding to the middle of the region 1069-1161 MHz.

The middle sub portion of the Link 16 band from 1050-1069 MHz is accommodated by disks 430 and 440 along with the corresponding dielectric. The third disk 430 is four wavelengths in radius at 1069 MHz at 44.3 inches. This cavity resonates at 1058 MHz with a spacing of 2.8 inches.

The lower sub portion of the Link 16 band from 966-1012 MHz is accommodated by disks 440, 450 along with the corresponding dielectric gap. Disk 440 is four wavelengths at 1012 MHz or 46.8 inches. The resonant cavity is set at 987 MHz or three inches. Disk 450 is four wavelengths at 966 MHz or 49 inches. The foam below disk 450 is simply to stiffen the foil of the conductor providing mechanical stability of the structure. In the example above, the open cell foam is treated as air as the dielectric is nearly unity.

In this example, the overall frequency extent of the Link 16 band compared to the center frequency results in a quality factor of around 4.4. By subdividing the Link 16 band into four sub portions with the quality factor of the largest sub portion of about 22 results in a smooth isolation across the full Link 16 frequency band. The quality factor 22+ of the stacked disks gives about 5 dB increase in isolation over a single plate. Further subdividing the band and increasing the number of disks and chambers will improve the isolation at the cost of increased weight and complexity.

Figures 4B, 5:
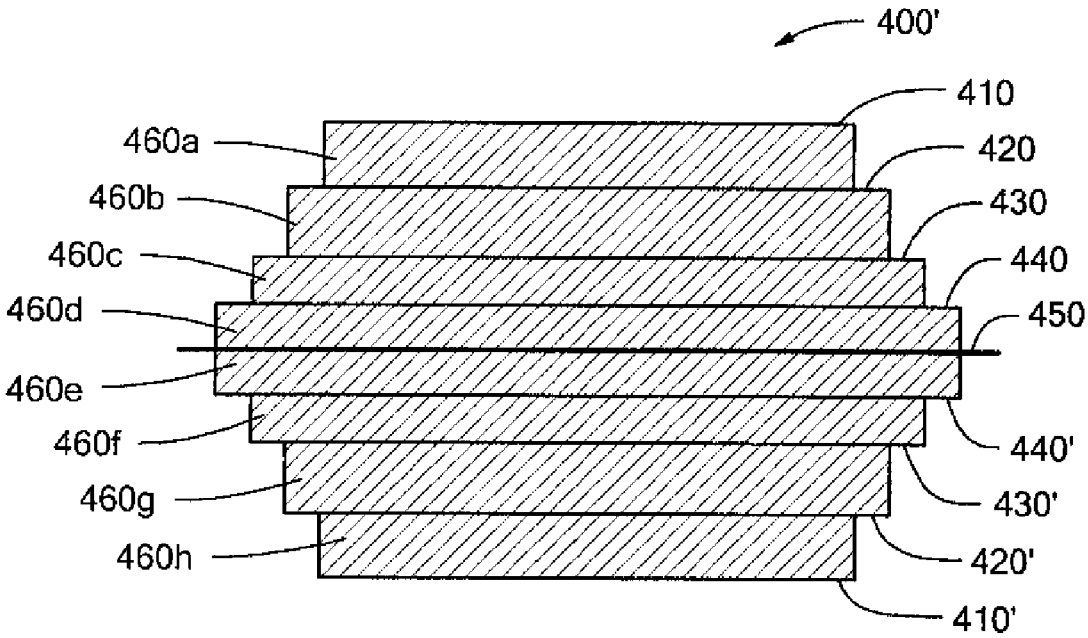
FIG. 4B is a schematic cross-sectional view of a further embodiment of an apparatus to provide bidirectional antenna isolation in accordance with exemplary embodiments of the invention.
FIG. 5 is a tabular representation showing physical dimensions of an exemplary embodiment of an apparatus.

The structure of the example above is intended to isolate the upper antenna from a lower antenna. As shown in FIG. 4B, should isolation be required in both directions, such as for a cellular application, then a plate 400', in addition to the layers 410-450 in having another stack of disks 410', 420', 430', 440' would be placed below the largest disk 450 along with respective dielectric layers 460*f-h* according to the frequency band of the lower radiator. In such applications, the four wavelength or larger radii of the disks (or plates) assure isolation when the horizontal extent of the radiators is small. It is understood that if the frequency regime of the two antennas was identical then the layer configurations would be mirrored about the fifth (largest) layer as shown in FIG. 4B. If the lower antenna is of different bandwidth and/or if the center frequencies are not the same for both antennas, then the plate is configured to cover the respective frequencies of operation as described in detail above to effectively isolate the respective antennas. For a cellular application, for example, the center frequencies of the antennas could be different (or could be the same) and bandwidths are likely the same.

FIG. 5 is a table listing the dimensions for an exemplary embodiment of the apparatus shown in FIG. 4. It is understood that these dimensions are directed to a particular arrangement of first and second antennas having respective operating frequency ranges. Other embodiments will have other dimensions and number of plates to meet the needs of a particular application.

Figure 6:
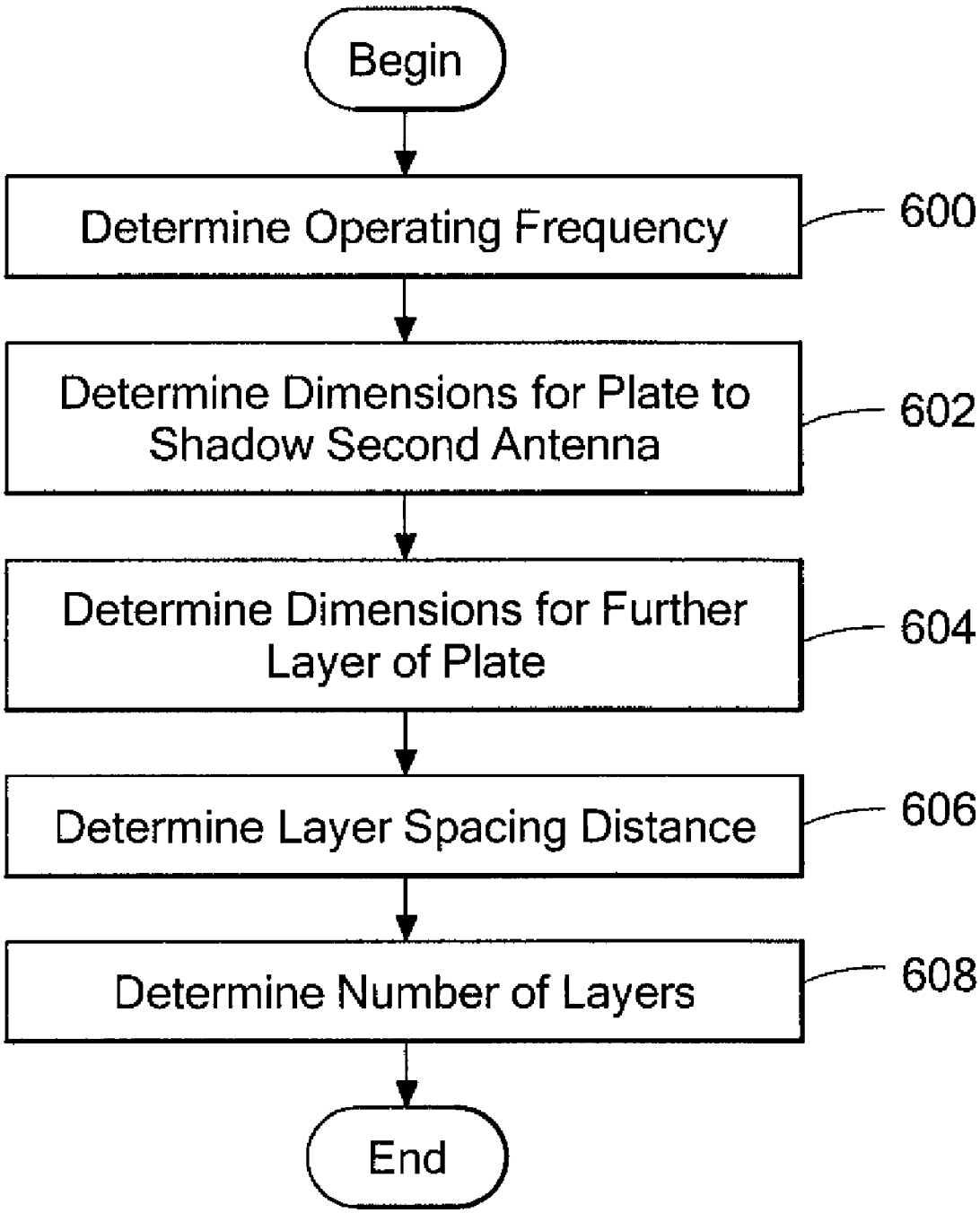
FIG. 6 is a flow diagram showing an exemplary sequence of steps to prevent a first antenna from interfering from a second antenna in accordance with exemplary embodiments of the invention.

FIG. 6 is a flow diagram showing an exemplary sequence of steps to provide an RF blocking plate in accordance with exemplary embodiments of the invention. In step 600, an operating frequency band for a first antenna is determined. In step 602, it is determined, for a collated second antenna, the dimensions for a first conductive layer that will shadow the second antenna a given distance from the first antenna. The dimensions for a second, larger conductive layer forming first and second concentric disks are determined in step 604. In one embodiment, the second conductive layer is sized to have a radius based upon an even number of wavelengths for an operating frequency. In step 606, the distance between the first and second conductive layers is selected. In an exemplary embodiment, the distance is about one quarter of the wavelength of a frequency in an operating frequency band so as to create resonance at that wavelength. The total number of conductive layers desired for the particular antenna installation system is then selected in step 608 using quality factor guidelines as shown in the example above.

Having described exemplary embodiments of the invention, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

What is claimed is:

1. An apparatus, comprising:

a first conductive layer;

a first dielectric layer proximate the first conductive layer;

a second conductive layer substantially parallel to the first conductive layer and proximate the first dielectric layer so that the first and second conductive layers sandwich the first dielectric layer to create a resonant cavity for reducing radio frequency interference between a collocated first antenna and a second antenna operating in a first frequency band;

a third conductive layer substantially parallel to the second conductive layer and proximate a second dielectric layer so that the second and third conductive layers sandwich the second dielectric layer to create a further resonant cavity, wherein the second conductive layer is larger than the first conductive layer to redirect energy due to diffraction at an edge of the first conductive layer, and the third conductive layer is larger than the second conductive layer to redirect energy due to diffraction at an edge of the second conductive layer, wherein the first and second conductive layers are spaced at a quarter wavelength for a first frequency in the first frequency band and the second and third conductive layers are spaced at a quarter wavelength for a second frequency in the first frequency band.

2. The apparatus according to claim 1, wherein the first and second layers are parallel to within a variation of one-tenth of a wavelength within the frequency band.

3. The apparatus according to claim 1, wherein the first conductive layer has a surface area that is sufficient to shadow the first antenna from the second antenna.

4. The apparatus according to claim 1, wherein a thickness of the dielectric layer is selected to take into account attenuation of velocity of wave propagation to achieve the one-quarter wavelength.

5. The apparatus according to claim 1 wherein the dielectric layer includes a foam material.

6. The apparatus according to claim 1 wherein the first, second, and third conductive layers are concentric circular disks.

7. The apparatus according to claim 1, wherein a radius of the first conductive layer is an even multiple of a wavelength of the first frequency and a radius of the second conductive layer is an even multiple of the second frequency.

8. The apparatus according to claim 1, further including a fourth conductive layer substantially parallel to the third conductive layer and sandwiching a third dielectric layer, wherein the fourth conductive layer is smaller than the third conductive layer.

9. A method, comprising:

providing a first conductive layer;

providing a first dielectric layer proximate the first conductive layer;

providing a second conductive layer substantially parallel to the first conductive layer and proximate the first dielectric layer so that the first and second conductive layers sandwich the dielectric layer to create a resonant cavity for reducing radio frequency interference between a collocated first antenna and a second antenna operating in a first frequency band; and providing a third conductive layer substantially parallel to the second conductive layer and proximate a second dielectric layer so that the second and third conductive layers sandwich the second dielectric layer to create a further resonant cavity, wherein the second conductive layer is larger than the first conductive layer to redirect energy due to diffraction at an edge of the first conductive layer, and the third conductive layer is larger than the second conductive layer to redirect energy due to diffraction at an edge of the second conductive layer, wherein the first and second conductive layers are spaced at a quarter wavelength for a first frequency in the first frequency band and the second and third conductive layers are spaced at a quarter wavelength for a second frequency in the first frequency band.

10. The method according to claim 9, wherein the dielectric layer includes a foam material.

11. The method according to claim 9, wherein the first and second conductive layers are concentric circular disks.

12. The method according to claim 9, wherein the plate optically shadows the second antenna.

13. The method according to claim 9, wherein a radius of the first conductive layer is an even multiple of a wavelength of the first frequency and a radius of the second conductive layer is an even multiple of the second frequency.

* * * * *

UNITED STATES PATENT AND TRADEMARK OFFICE

CERTIFICATE OF CORRECTION

PATENT NO. : 7,612,731 B2
APPLICATION NO. : 11/693971
DATED : November 3, 2009
INVENTOR(S) : Lewis Peterson It is certified that error appears in the above-identified patent and that said Letters Patent is hereby corrected as shown below:

Col. 7, line 19, delete "collated" and replace with --collocated--

Signed and Sealed this

Fifth Day of January, 2010

David J. Kappos

David J. Kappos
*Director of the United States Patent and Trademark Office*